United States Patent [19]

Baguena Molina

[11] Patent Number: 4,739,592

[45] Date of Patent: Apr. 26, 1988

[54] PROTECTIVE AWNING FOR SCAFFOLDING AND TUBULAR STRUCTURES

[76] Inventor: Maria del Pilar Baguena Molina, Santa Hortensia 22, 28002-Madrid, Spain

[21] Appl. No.: 878,054

[22] Filed: Jun. 24, 1986

[30] Foreign Application Priority Data

| | | | |
|---|---|---|---|
| Jun. 26, 1985 | [ES] | Spain | 287.686 |
| Dec. 6, 1985 | [ES] | Spain | 290.818 |
| Mar. 20, 1986 | [ES] | Spain | 293.106 |

[51] Int. Cl.[4] ..... E04B 5/52

[52] U.S. Cl. ..... 52/63; 52/83; 52/96

[58] Field of Search ..... 52/63, 83, 222, 90–96, 52/639–642, 645; 160/392; 135/106; 182/178; 403/300–306

[56] References Cited

U.S. PATENT DOCUMENTS

| | | | |
|---|---|---|---|
| 576,858 | 2/1897 | Knopfe et al. | 182/178 |
| 2,144,747 | 1/1939 | Adams | 135/106 |
| 2,787,321 | 4/1957 | Dietz | 160/392 |
| 3,121,470 | 2/1964 | Stone et al. | 182/178 |
| 3,564,784 | 2/1971 | Mollinger | 52/63 |
| 3,844,080 | 10/1974 | Brock et al. | 52/222 |
| 4,485,599 | 12/1984 | Perradin | 52/222 |

FOREIGN PATENT DOCUMENTS

| | | | |
|---|---|---|---|
| 1195545 | 5/1959 | France | 52/63 |

*Primary Examiner*—James L. Ridgill, Jr.
*Attorney, Agent, or Firm*—Ladas & Parry

[57] ABSTRACT

A protective awning for scaffolding and tubular structures of the type generally used in restoration of buildings and construction in general. A laminar piece of cloth, canvas or similar material constituting the awning proper is fitted on a bearing structrue formed from tubular elements welded together. The bearing structure is finished at the bottom by vertical sections with a sleeve welded to the free or bottom ends thereof, in which sleeves the top ends belonging to the structure of the scaffolding are housed and attached, and are fixed by radial screws provided in the sleeves. The extreme lateral zones have a bar for the passage of the awning over them, each of which is complemented by a mechanism for securing the awning to the bearing structure. The mechanism is formed by sections welded to the structure which are fixed to each other, through which there passes a screw with a nut for tightening the cloth of the awning, the head of said screw being positioned in a hollow bar which is passed through a sleeve attached to the awning.

8 Claims, 5 Drawing Sheets

PROTECTIVE AWNING FOR SCAFFOLDING AND TUBULAR STRUCTURES

The invention relates to a protective awning for scaffolding and tubular structures, constituting what may be considered to be a roof for the scaffolding utilised in works of restoration of buildings and construction in general.

The placing of the awing of the invention on scaffolding preserves the work area and prevents the workers from losing hours of work owing to the inclemencies of the weather, basically rain and snow, and also in period of summer or heat the workers will be protected from the sun, with a logical increase in efficiency.

Therefore the awning of the invention constitutes a medium which enables the workers or labourers acting on open air scaffolding to offer a greater efficiency, which means in turn that the company contracting the construction or restoration of buildings will meet the planned completion dates, and thus keep to the established costs, as it will not be necessary to pay for unproductive wages as there will be no days work lost.

The utilisation of scaffoling based on tubular structures for the restoration of facings, erection of buildings, etc is becoming every day more extensive; therefore the awing of the invention represents a technological advance, as greater efficiency in the performance of these tasks is achieved by means of it.

Basically, the awning we are dealing with is constituted from a plasticised cloth or canvas which is fitted on to a bearing structure based on tubular sections, which is provided with means for its attachment to a conventional scaffolding, constituting an upwards continuation of the latter. The cloth or canvas is tied to means for its tightening and fixing in respect of the bearing structure mentioned above, and the latter may be formed to define one or two slopes.

The above mentioned bearing structure is constituted, according to one form of embodiment, by tubes welded together, duly attached and positioned with respect to each other. This structure, though efficacious and safe, may be said to be costly in its fabrication.

In order to improve said bearing structure, a second advantageous form of embodiment has been conceived, which consists of the above mentioned bearing structure being constituted by a single tubular piece adopting an appropriate and open profile to serve as a support for the cloth or canvas and in addition to determine the struts or means of attachment to the conventional scaffolding.

In a third improved variant, the bearing structure mentioned in the previous paragraph adopts the form of a closed section, on one of the lengths of which one of the struts for the attachment to the scaffolding is mounted in a movable way, in order to adapt to the width of the latter.

These and other advantages will be explained with the aid of the attached drawings, on the basis of which the invention will be described. These drawings show:

Figure 1:
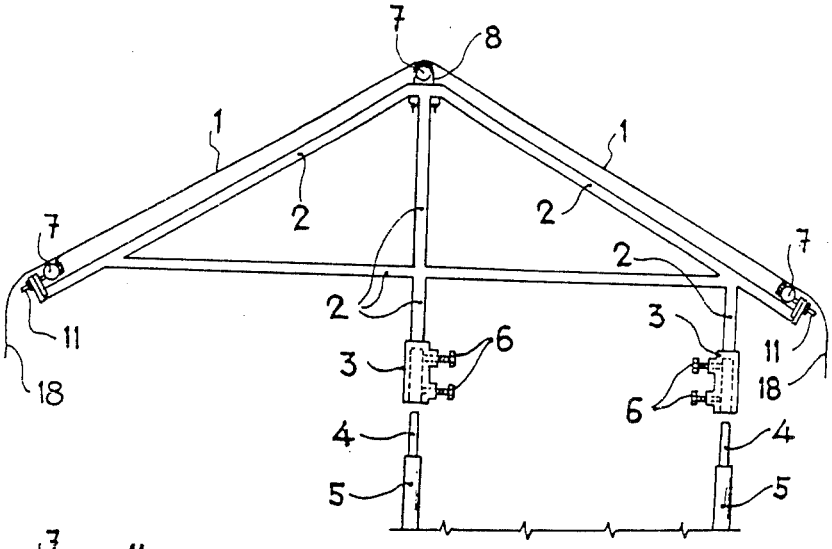
FIG. 1 shows a lateral view of a double sloped awning with its corresponding bearing structure, all of which is according to a preferential form of embodiment.

In relation with FIGS. 1–4, it is considered that the awning of the invention is formed by a laminar piece (1), either a plasticised cloth or canvas, and a bearing structure (2) supporting said laminar piece (1) or cloth. Said bearing structure (2) is formed by tubular elements welded together, with the forms and combinations desired and which may be best suited to needs, such as the width of the cloth (1) and the variants of shape and configuration it may adopt, whether of one slope, two slopes, or even more slopes.

The bearing structure (2) formed by the tubular elements, is attached at the bottom to sleeves (3) or union elements to which in turn the top ends (4) corresponding to the structure of the scaffolding (5) of the works are attached. The attachment between the tubular elements (2) and sleeves (3) may be effected by welding, screwing, etc.; whereas the attachment and securing of the top ends (4) to these sleeves will be effected with the collaboration of radial or lateral tightening screws (6).

Figure 3:
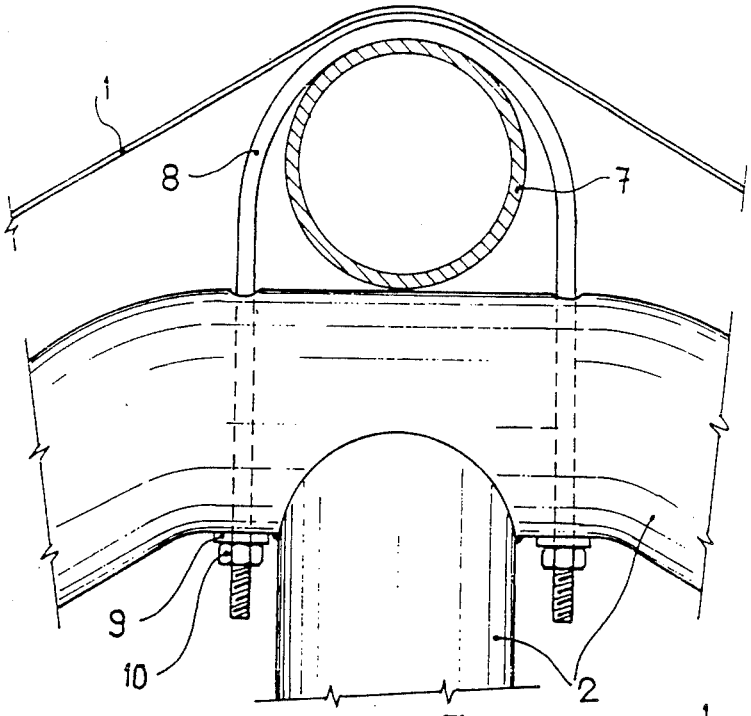
FIG. 3 shows a detailed view of a cross section part corresponding to the apex or top vertex of the awning shown in FIG. 1.
Figure 4:
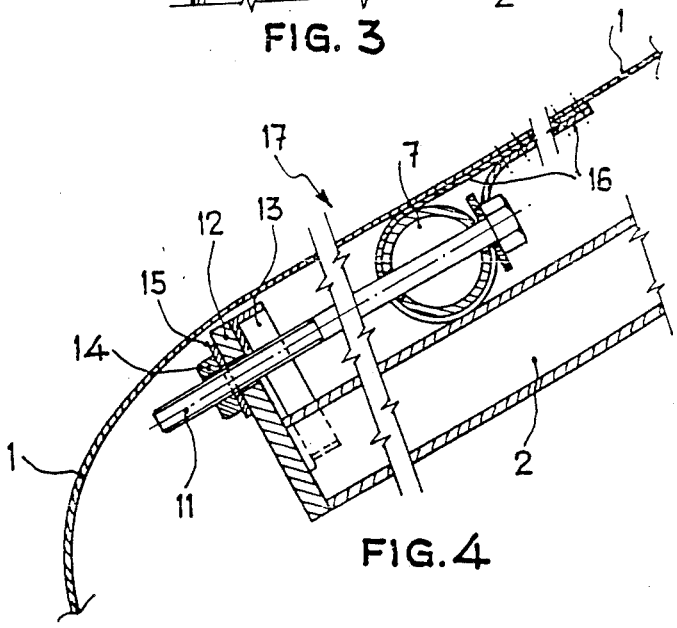
FIG. 4 shows a detail in cross section of one of the lateral or extreme parts of the awning shown in FIG. 1, where the mechanism for tightening the said awning may be seen.

In the case of the double sloped awning shown in FIG. 1, when the frames have been positioned and attached to the scaffolding, the bar (7) situated above the upper vertex of both frames will be placed over them, passing the bar (7) along the axis of the curved screw (8) passing through said bar (2) by means of eyelets and which is fixed with the nuts and washers (9) and (10) as shown in FIG. 3.

At the lateral ends of the bearing frames the screw or securing elements (11) are placed, consisting of a metallic check section (12), welded to the head of the tube (2) of the bearing structure and another section (13), also welded to the above and to the tube and which will serve as a stiffener and brace for the assembly. The two sections mentioned and the tube (7) forming part of the awning, have eyelets through which the screw (11) is inserted which, with its corresponding nuts (14) and washers (15) serve to tighten the cloth (1) of the awning. The awning has some supplements (16) stitched to it, which house the tube (7) and some eyelets coinciding with the position of the screw.

Figure 2:
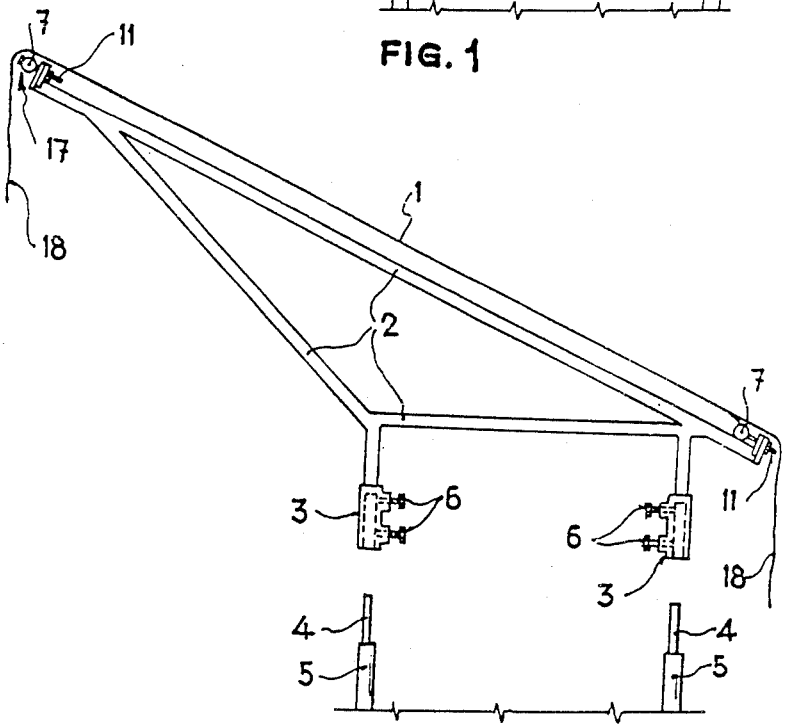
FIG. 2 shows a view similar to the above, in which the awning forms a single slope.

FIG. 2 shows the single sloped awning, having the same fundamental parts as the double awning; i.e. the tubular elements (2) which give the shape to the bearing structure of the cloth (1) of the awning; the bars (7); the attaching sleeves (3); the ends (4) of the scaffolding (5) for the attachment of the bearing structure; the mechanisms (17) for securing the cloth (1) of the awning to the bearing frame or tubular elements (2), serving to tighten and fit said cloth (1) of the awning; also having the mechanism (17) for securing said cloth (1) to the frame, at the top.

When the needs so require, several adjoining structures such as those described may be erected, joining the corresponding awnings (1) together by their lateral hanging flaps (13) to form a continuous surface for the protection of the labourers working on the scaffolding (5).

Figure 5:
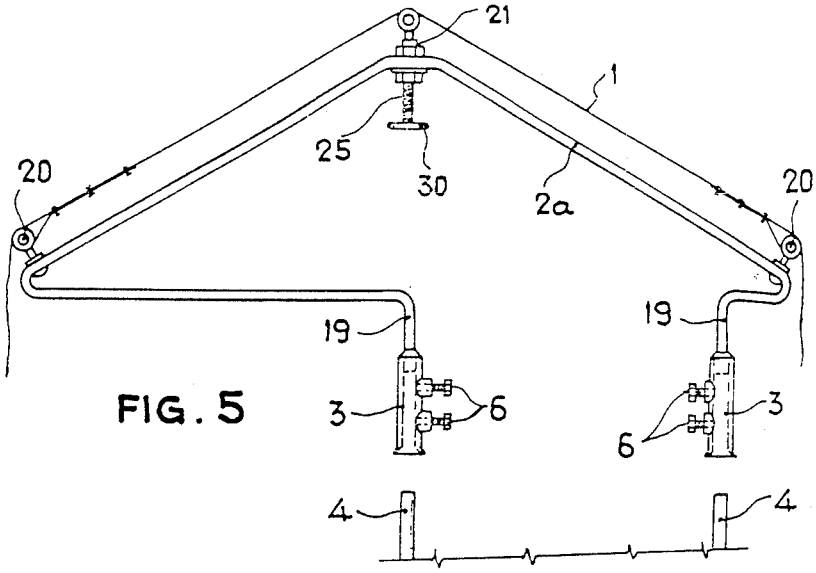
FIG. 5 shows a lateral view of a second preferential form of embodiment of the awning, in which the bearing structure is constituted by a single tubular piece.
Figure 6:
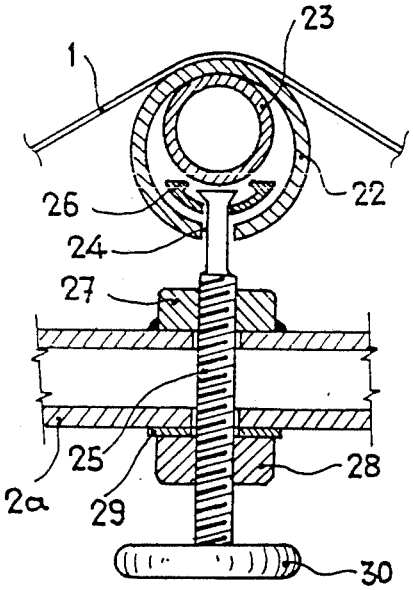
FIG. 6 shows a detailed cross section view of the tightening mechanism of the awning, according to the form of embodiment of FIG. 5.
Figure 7:
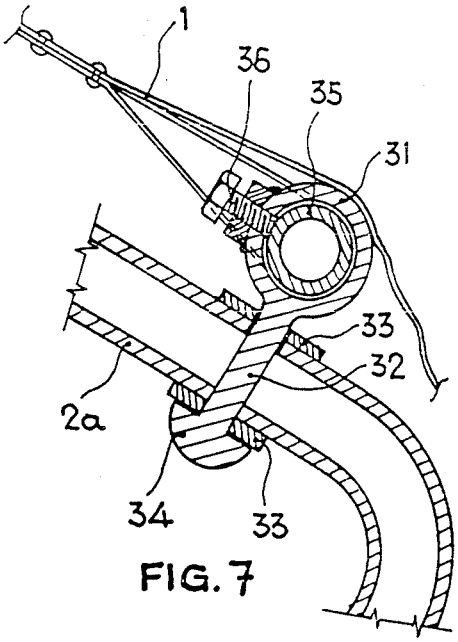
FIG. 7 shows a detailed cross section view of a lateral part of the awning where the mechanism for its fixing to the bearing structure can be seen, all of which is according to the embodiment of FIG. 5.

FIGS. 5, 6 and 7 show a different and advantageous form of embodiment of the awning described. In this case the bearing structure (2*a*) is formed by a single piece which adopts the form of an open tubular section of two slopes, which supports the canvas or cloth (1). Said bearing structure (2*a*) presents underneath two vertical sections (19) on which the bushes or sleeves (3) destined to receive the top ends (4) of the structure of the corresponding scaffolding, are welded or screwed, as described for FIG. 1, having, as in this case, radial or lateral tightening screws (6) to effect the fixing of the bearing structure (2*a*) on the structure of the scaffolding.

The canvas or cloth (1) is fixed at its sides on respective fixing elements (20) provided in the sides of the bearing structure (2), whereas at the top of the latter there is an element (21) for tightening the canvas or cloth (1).

The said tightening element (21) is shown in detail in FIG. 6, and is constituted by a bushing (22) inside which is fitted a tube (23) of smaller diameter, the bushing (22) being provided internally with an opening (24) for the passage of a screw (25) the free end of which has a pushing element (26) which will make contact with the tube (23). Said screw (25) passes through the tube constituting the bearing structure (2), presenting a nut (27) welded to the latter and a free tightening nut (28), there existing between the latter and the tube of the bearing structure (2*a*) a washer (29), the screw (25) being finished in a drive head (30), such as a cross member, disc or similar.

By means of this tightening element, the canvas or cloth (1) can be tightened at will simply as it will be sufficient to turn the screw (25) for the pushing element (26) to press against the tube (23) moving it upwards and taking with it the bushing (22), which will cause the canvas or cloth (1) to be tightened.

FIG. 7 shows the detail of one of the two analogous fixing elements (20) of the cloth or canvas, said element being formed by a bushing (31) which extends radially in a type of fishbolt (32) passing through the tube constituting the bearing structure (2*a*), after the intercalation of an equal number of flat washers (33), and said fishbolt (32) ending in a head (34) in the form of a rivet or welded nut. This bushing (31) will be capable of being oriented in rotation, according to the positioning or fitting of the fishbolt (32) belonging to same. On this bushing (31) there is mounted internally a tube (35) to which the cloth or canvas (1) is fixed and the tube of which (35) is tightened by a radial screw (36).

As a consequence of the possibility of rotation of the bushing (31), and therefore of its orientation, it is possible to insert the tube (35) in any position, i.e. whatever the inclination of the scaffolding, independently of its squaring or any type of off-centeredness of the elements.

Figure 8:
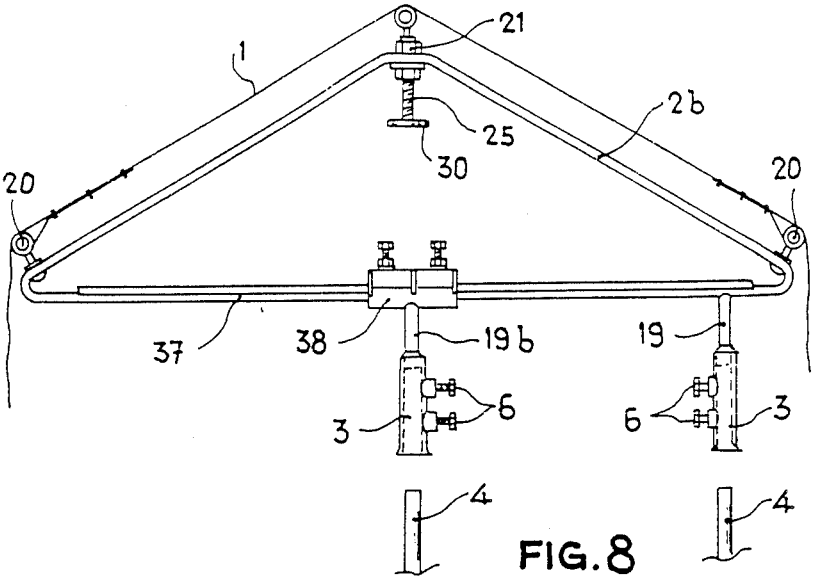
FIG. 8 shows a lateral view of the awning in a third form of embodiment, in which the bearing structure is a single tubular piece the section of which is closed.
Figure 9:
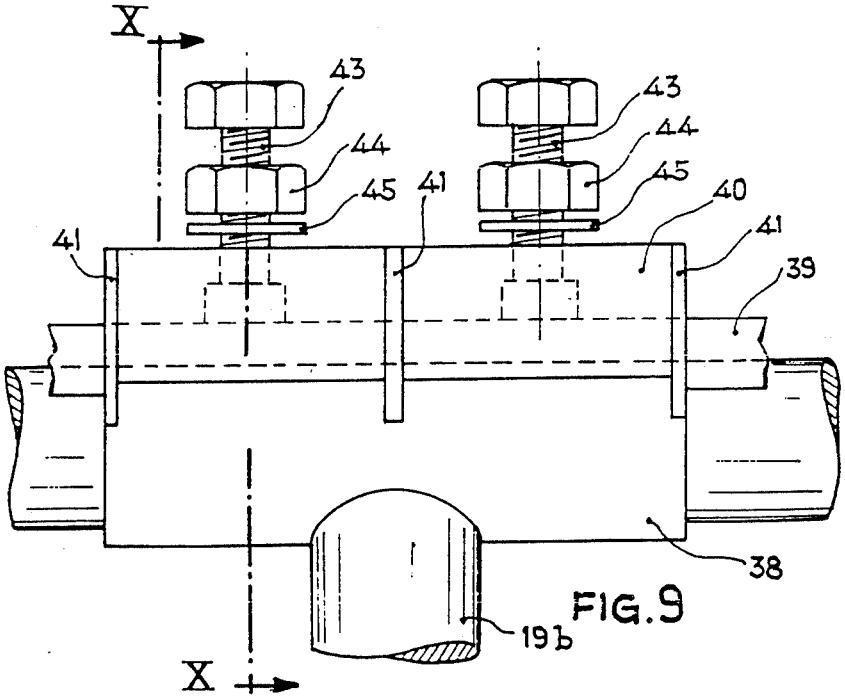
FIG. 9 shows a detailed view of the device allowing one of the struts attaching the bearing structure to the scaffolding to be movable or sliding, according to the embodiment of FIG. 8.
Figure 10:
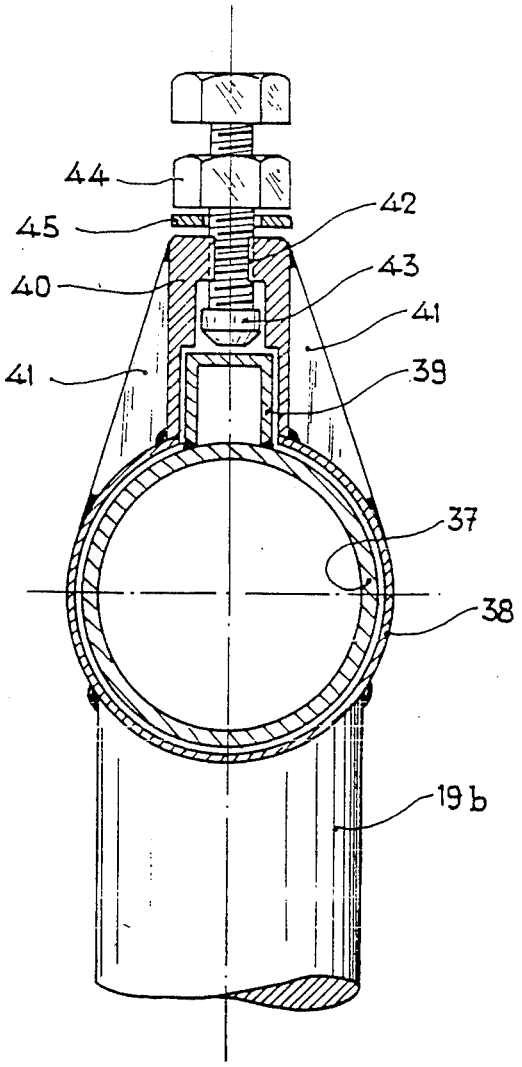
FIG. 10 shows a sectional view along the plane X—X of the preceding figure.

FIGS. 8 to 10 show another form of embodiment of the awning, so that in this case the bearing structure (2*b*) is, like in the previous case, formed by a single tubular piece but in this new embodiment, the section is closed to determine a triangular outline (FIG. 8) which will configure the double sloped awning.

As in the awning shown in FIGS. 5 to 7, the cloth (1) is tightened by the tightening element (21), and fixed by the lateral fixing elements (20); whereas the coupling and fixing of the bearing structure (2*b*) on the top sections (4) of the scaffolding is effected by means of the lower sections (19) and (19*b*), which have their corresponding bushing or sleeve (3) and the radial tightening screws (6).

The said lower sections (19) and (19*b*) are arranged on the lower horizontal branch (37) of the bearing structure (2*b*), section (19) being fixed and section (19*b*) being movable and may be moved along the said bottom horizontal branch (37).

The movable section (19*b*) is solid with a bushing (38) which slides along the horizontal branch, in order to take apart or bring closer together the sections (19) and (19*b*), permitting their attachment to any conventional scaffolding.

On the horizontal tubular branch (37) there is welded at the top and lengthwise an inverted U section (39) which is constituted as a runner to prevent the rotation of a section (40) in which the bushing (38) extends. This section (40) has some lateral stiffeners (41) and is in turn provided with threaded holes (42) for respective screws (43) passing through the tightening nut (44), washer (45) and the corresponding threaded hole or orifice (42).

The internal end of these screws (43) is finished in a head which, when said screws (43) are tightened, will press against the section (39) thus ensuring the immobilization of the bushing (38), whereas when the screws (43) are unscrewed, the bushing (38) can be slid. These screws (43), when unscrewed, cannot come out of the holes or orifices (42) as this will be prevented by the internal head of each.

I claim:

1. A releasably attachable awning for use with scaffolding, said awning comprising:

a tubular element which forms an angle with the vertical and includes a top apex and a bottom opposite said top apex;

an apex tightening means and a bottom fixing element, said apex tightening means being attached to said tubular piece in the vicinity of said apex, said bottom fixing element being attached to said tubular element in the vicinity of said bottom;

a covering stretching over said tubular element said covering connecting to and overlying said bottom fixing element and overlying said apex tightening means;

receiving means for connecting said tubular elements to a scaffold.

2. The awning of claim 1 wherein said covering is spaced from and generally parallel with said tubular element and wherein said bottom fixing element and said apex tightening means lie generally of said tubular element.

3. The awning of claim 1 wherein said apex tightening element extends through the apex area of said tubular element and is comprised of:

a threaded rod having a turning end and an adjustment end opposite said turning end, said turning end having a widened drive head for rotating said tightening element toward and away from said covering, said turning end further having a first washer and nut which surrounds said threaded circular member and engages said tubular member near said drive head, said adjustment end being comprised of a gradually widening stem;

a generally hollow circular member movably mounted on said stem, said widened portion of said stem preventing said stem from being completely withdrawn from said generally hollow member; and a cylindrical member received within said generally hollow member and supported by said widened portion of said stem, said cylindrical member extending generally normal of said tightening element and said tubular element to support said cover at said apex area, said cylindrical member being moveable within said generally hollow member by means of said stem, such that upon turning said drive head such that it approaches said cover, said widened portion of said stem pushes said cylindrical member and therefore said generally hollow member away from said tubular element.

4. The awning of claim 1 wherein said receiving means includes a hollowed sleeve for receipt of said scaffolding member and tightening means, said tightening means extending through said sleeve and abutting said scaffolding member such that upon tightening of said tightening means against said scaffolding member, said scaffolding member is held fixedly within said hollow sleeve.

5. The awning of claim 1 wherein said covering includes engagement means and wherein said bottom fixing element is comprised of a connecting means passing through said tubular element and engageable with said engagement means, said connecting means being comprised of:

a first end;

a second end lying opposite of said first end;

a stem extending between said first end and said second end;

and a screw and washer associated with said second end and said engagement means, said first end being larger than said stem and generally abutting said tubular member and lying opposite of said covering when said connecting means is inserted through said tubular element, said second end being generally circular in shape and defining a generally central opening for receiving said engagement means, said screw extending through said washer and then through said second end to abut said engagement means such that by rotation of said screw toward said second end, said engagement means are held tightly within said second end so that said covering extends generally normal of said tubular member and said connecting means.

6. The awning of claim 5 wherein said tubular piece is triangular in shape and defines a base portion along which the tubular piece extends as well as two side portions which angularly extend from said base portion to form said apex, said bottom of said tubular element being defined at the two corners established by the base portion of the triangle and the two sides.

7. The awning of claim 6 further including a second bottom fixing element so that said covering stretches over both of the said bottom fixing elements as well as said apex to form a triangular roof.

8. The awning of claim 6 further including a sliding member, said sliding member being slidably engaged with said base of said tubular element and attachable to said receiving means, said sliding member being comprised of:

a U-section, said U-section being parallel to said base of said tubular element and fixedly attached thereto;

a sleeve slidably engaged with said U-section and said tubing element, said U-section preventing said sleeve from rotation about said tubular element;

and rotatable securement means extending through said sleeve and abutting said U-shaped member such that upon tightening of said rotatable securement means against said U-shaped member, said sliding member is solidly fixed to said tubular element.

* * * * *